US005794426A

United States Patent [19]

Neff

[11] Patent Number: 5,794,426

[45] Date of Patent: Aug. 18, 1998

[54] DEVICE FOR THREADING IN THE THREAD DURING THE CHANGE OF A RING TRAVELLER

[75] Inventor: Andreas Neff, Pfäffikon, Switzerland

[73] Assignee: Bracker AG, Pfaffikon, Switzerland

[21] Appl. No.: 687,541

[22] PCT Filed: Nov. 13, 1995

[86] PCT No.: PCT/CH95/00264

§ 371 Date: Aug. 5, 1996

§ 102(e) Date: Aug. 5, 1996

[87] PCT Pub. No.: WO96/19602

PCT Pub. Date: Jun. 27, 1996

[30] Foreign Application Priority Data

Dec. 22, 1994 [CH] Switzerland ..... 03 889/94

[51] Int. Cl.[6] ..... D01H 7/60

[52] U.S. Cl. ..... 57/262; 57/279; 57/353

[58] Field of Search ..... 57/262, 279, 75, 57/1 R, 353; 29/765

[56] References Cited

U.S. PATENT DOCUMENTS

| | | | |
|---|---|---|---|
| 3,398,521 | 8/1968 | Bell et al. | 57/262 |
| 3,486,319 | 12/1969 | Lee, Jr. et al. | 57/262 |
| 3,498,041 | 3/1970 | Sandager | 57/262 X |
| 3,546,870 | 12/1970 | Schewe et al. | 57/262 |
| 3,664,109 | 5/1972 | Escursell-Prat | 57/262 X |
| 3,855,769 | 12/1974 | Morton | 57/262 |
| 4,155,215 | 5/1979 | Igel et al. | 57/262 |
| 5,303,464 | 4/1994 | Neff | 29/765 |
| 5,390,483 | 2/1995 | Koga et al. | 57/262 |
| 5,417,045 | 5/1995 | Otoshima | 57/262 X |

FOREIGN PATENT DOCUMENTS

| | | | |
|---|---|---|---|
| 406228834 | 8/1994 | Japan | 57/262 |
| 406240526 | 8/1994 | Japan | 57/262 |

*Primary Examiner*—John M. Jillions
*Assistant Examiner*—Tina R. Taylor
*Attorney, Agent, or Firm*—Adams Law Firm, P.A.

[57] ABSTRACT

A lever (30) is pivotably mounted about ax axis Z on a carrier journal (24) which is pivotable about an axis X and with which electromagnets (46, 48) cooperate. The lever carries a thread-receiving member (20) and is under the effect of a tension spring (42). When the thread is intercepted by the thread-receiving member during the forward rotation of the cop, there follows a deflection of the thread-receiving member, which takes place with the tension spring being tensioned at the same time and which is caused by the thread, on a path approximate to the movement of the traveller on the ring. The tensioned tension spring pivots the thread-receiving member during the paying-out of thread which occurs as a result of the subsequent reverse rotation of the cop. As a result of the intermediate blocking about one of the axes, the thread-receiving member moves on a path lying approximately in a tangential plane relative to the ring. Starting from the old traveller retained on the ring, the thread is stretched on a threading-in zone extending in this plane. During the attachment of the new traveller onto the ring, the thread is grasped on the threading-in zone and is thereby threaded into the ring.

3 Claims, 4 Drawing Sheets

DEVICE FOR THREADING IN THE THREAD DURING THE CHANGE OF A RING TRAVELLER

This application is a national stage application, according to Chapter I of the Patent Cooperation Treaty.

TECHNICAL FIELD AND BACKGROUND OF THE INVENTION

The invention relates to a device for practicing a method of threading in the thread during the change of a ring traveller.

Such a method is known from German Offenlegungsschrift 4230736. In this, the cop is first rotated in reverse, in order to provide a thread reserve by the unwinding of thread from the cop. Movable combs which intermesh and between which the thread extends through lay the thread reserve in loops between the comb teeth. The old traveller seated on the ring is thereupon brought into a predetermined circumferential position on the ring, for which purpose the cop has to be rotated forwards and the thread drawn through between the comb teeth.

The thread is subsequently located on each of the two sides of the traveller by a catch hook and stretched in opposite directions on a path predetermined relative to the ring. The thread length required for this purpose is drawn additionally from the thread reserve. Before or while the new traveller is attached onto the ring, this traveller grasps the thread in the part stretched between the catch hooks. After the insertion of the new traveller, the rest of the thread reserve is wound onto the cop again.

The locating and grasping of the thread unwound from the cop involves steps which may be detrimental to the efficiency of the known method. Even when the two catch hooks find the thread in order to stretch this along the predetermined path, there is at least the problem of counteracting the risk of a thread break during stretching. The thread length required for stretching on the ring is relatively great and has temporarily had to be unwound at the expense of some considerable time. In order to avoid the thread break, stretching must take place, with the thread tension exerted by the two thread hooks being limited at the same time. A further difficulty is that thread length is required on both sides of the ring traveller, but can be additionally drawn only from one side, namely that connected directly to the reserve. The change of the traveller therefore takes up a relatively large amount of time.

SUMMARY OF THE INVENTION

The object of the invention is to provide a method which substantially simplifies the stretching of the thread for threading in and which can be carried out without appreciable delay.

Since, here, a positioning of the old traveller, the said positioning preceding the locating or grasping of the thread, is dispensed with and the thread is grasped, without a thread reserve previously having had to be formed, there is no need for preparatory steps and preparatory time. In this method, the locating of the thread is reliable and elegant in as much as it automatically assumes the catching position with the rotation of the cop. Since, on the other hand, the traveller, round which the thread is looped, is positioned as a consequence of the rotation of the cop, the said traveller can be used for stretching the thread on the threading-in zone as one of its end points. Consequently, the thread length required is reduced and it is possible to avoid drawing out thread on two sides.

The invention therefore affords a device which utilizes circumstances prevailing at the spinning station, namely, on the one hand, the known course of the thread rotation path during the rotation of the cop and, on the other hand, the old traveller positioned on the ring. On this basis, despite a simple design, the device works extremely reliably and needs little time for a complete operation to change the traveller. It is of great importance for reliability that the device itself makes do with a single member for thread engagement, thus considerably reducing the risk of thread breaks during the change of traveller.

The use of the energy storage means engaging on the thread-receiving member ensures that the tensile forces taking effect on the thread during stretching in the threading-in zone do not exceed the amount which the thread previously transmitted itself by means of the same thread member. Thread breaks during the change of traveller are thereby effectively avoided.

BRIEF DESCRIPTION OF THE DRAWINGS

The method according to the invention and the device according to the invention are explained below by means of an exemplary embodiment and with reference to the drawing. In this.

DESCRIPTION OF THE PREFERRED EMBODIMENT AND BEST MODE

Figure 1:
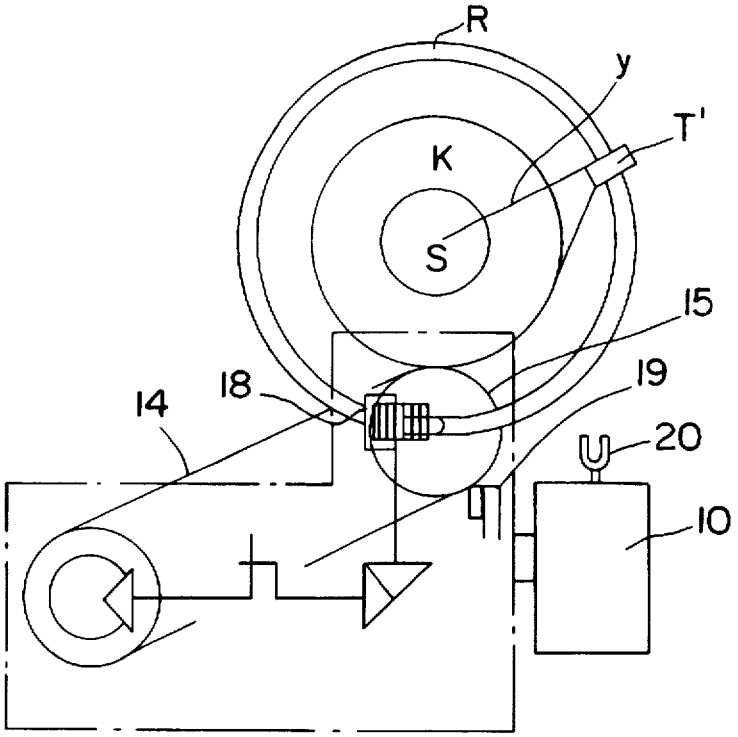
FIG. 1 shows diagrammatically, in horizontal projection, a spinning station of a ring spinning machine with a traveller-changing apparatus comprising the device according to the invention, in the traveller-changing position.

In FIG. 1, R denotes the spinning ring of an individual spinning station of a ring spinning machine, the said spinning ring being arranged on a spinning rail (not shown). A thread Y, which runs through a balloon limiter (not shown) arranged above a spinning spindle S, extends through a traveller T' located on the spinning ring R, in order subsequently to run on the cop K seated on the spinning spindle S. In the spinning mode, the spinning spindle S is driven in the clockwise direction in a known way, so that the traveller T' rotates in the same direction.

The method according to the invention for moving the thread for threading in, in conjunction with the change of the traveller at a spinning station, will be explained first in general terms. In this case, reference is made to the movements emerging from FIGS. 4 to 9.

Figure 5:
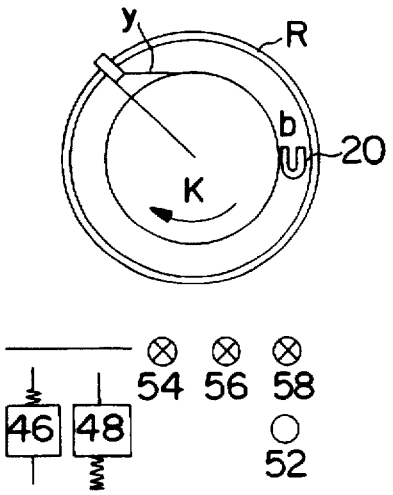
Figure 7:
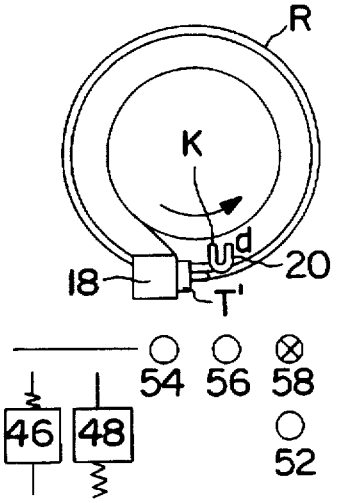

This method is begun by causing the thread Y and therefore also the traveller T' to rotate over a distance on the spinning ring R at the affected spinning station by briefly rotating the cop K. While this distance is being covered, a thread portion leading to the traveller is intercepted. This can be brought about reliably by waiting for the thread Y in the immediate vicinity of the ring, that is to say on a known path (FIG. 5). In a further step, a thread portion is stretched over a threading-in zone Y1 which has a predetermined position and direction relative to the ring. For this purpose, by means of a further rotation of the thread, the traveller T' is temporarily moved into a suitable position and retained there relative to the ring R (FIG. 7). At the same time, a force is stored via a thread pull generated by rotating the cop after the interception of the thread. Thread is drawn out, solely by means of this stored force, in order to be stretched on the threading-in zone, the thread tension thereby automatically remaining limited to a permissible amount.

Figure 8:
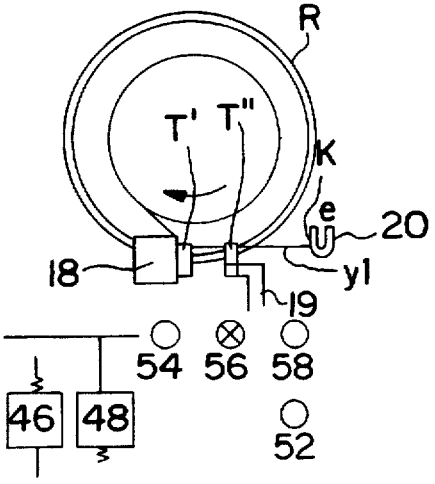
Figure 9:
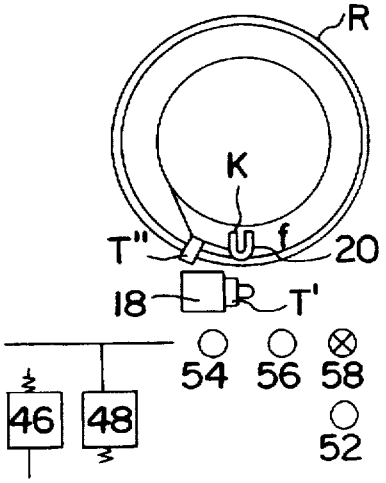

This threading-in zone begins or has one of its end points at the retained traveller T'. In order to obtain the necessary thread length for the threading-in zone, thread is unwound from the cop K preferably directly during the stretching. Subsequent attachment of the new traveller T" onto the ring can take place, for example, in a way known from EP-A1-0,505,715. The new traveller T" is guided, rearside forwards, onto the ring R radially from outside on a predetermined path. In the present case, the path is one which intersects the threading-in zone Y1. At all events in the case of C-shaped or similarly profiled travellers, further movement leads directly to hooking on the ring flange. The new traveller T" consequently grasps the thread positively before attachment (FIG. 8). In the attached traveller T", therefore, the thread is threaded in.

In a further step which can follow the attachment of the new traveller and the lifting-out of the old traveller, the thread is moved once again by rotating the cop and a check is made as to whether the traveller is at the same time taken up on the ring. This makes it possible to acquire positive feedback on the method faultlessly carried out or concluded within the scope of the change of traveller.

Before the device according to the invention is explained, the traveller-changing apparatus necessary in operating terms will be discussed. The traveller-changing apparatus, designated as a whole by 2, is mounted on the ring spinning machine temporarily, for example for changing the traveller, so as to be longitudinally movable at all the spinning stations of the said machine. For each change of traveller, the apparatus 2 stands in a stationary manner opposite a spinning station, specifically in a position suitable for changing the traveller on the spinning ring R. The apparatus 2 comprises, on the one hand, a changing device 4 which is designed, for example, in the manner represented in EP-A1-0,505,715. Next to this, part of the apparatus 2 is an auxiliary drive 6 (FIG. 10) for the spindle S, the said auxiliary drive being additionally present in comparison with the known changing device and being referred to below as the drive. The reason for the presence of such a drive is the aim, particularly in the present case, of carrying out the change of traveller, with the thread present and intact.

Figure 10:
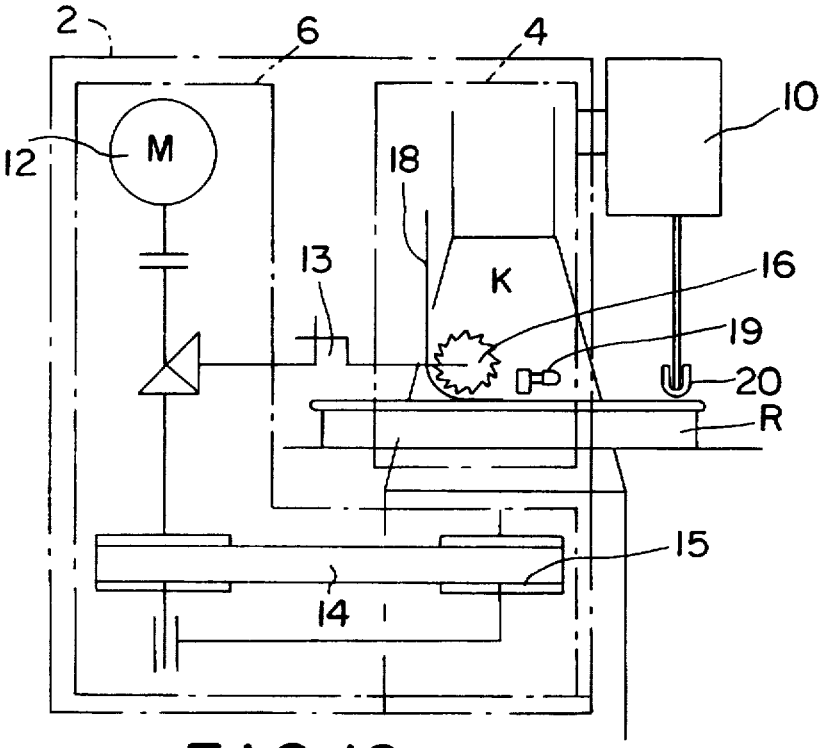
FIG. 10 shows the auxiliary spindle drive of the traveller-changing apparatus.

As is evident from FIG. 10, the drive 6 comprises an electric drive motor 12 which is connected via a lost-motion coupling 13 and a flexible shaft 14 to a friction wheel 15, on the one hand, and to a detent wheel 16, on the other hand. The detent wheel 16, which possesses a suitably toothed circumferential surface, is assigned to a lifting-out hook 18 in a way yet to be explained. Means (not shown) hold the friction wheel 15 in engagement with the cop K for the change of traveller.

Finally, the apparatus 2 is assigned the device 10 according to the invention, referred to below as a movement device, the design of which is explained with reference to FIGS. 2 and 3. The drive 6 and the movement device 10 are movable, together with the changing device 4, from spinning station to spinning station, the friction wheel 15 being additionally movable approximately transversely relative to this direction of travel. The apparatus 2 is equipped with a programmable control which allows autonomous operation on the spinning machine.

The movement device 10 comprises, as the main part, a movably mounted, fork-shaped thread member 20 which is pivotable on predetermined paths. In the exemplary embodiment shown, the thread member 20 is cardanically mounted on the changing device 4. In actual fact, a bearing element 22 is rigidly fastened to the changing device 4, a carrier journal 24 being pivotably mounted about an approximately horizontal axis X in the said bearing element. Rigidly fastened to the carrier journal 24 is a pivot bearing 26, in which an axle journal 28 of an L-shaped lever 30 is pivotably mounted about an axis Z. The lever 30, at its end remote from the axle journal 28, carries the thread member 20. The axis Z is pivotable in a radial plane of the axis X. In the pivoting position of the carrier journal 24 according to FIG. 2, the axis Z runs approximately horizontally. The parts 22 to 28 form a cardan joint for the thread member 20, the axes X and Z constituting the cardanic and articulation axes respectively.

An actuating plate 34 and a signal plate 36 are rigidly fastened, in addition to a stop arm 32, to the carrier journal 24. A tension arm 38 and a signal plate 40 are connected to the axle journal 28 in a rotationally rigid manner. An energy accumulator in the form of a tension spring 42 is rigidly anchored to the changing device 4 at 44 and engages on the tension arm 38. The actuating plate 34 is assigned two electromagnets 46 and 48 having respective return springs 47 and 49 and, in end positions yet to be explained, an adjustable stop screw 50 and an inductive sensor 52 cooperate respectively with the stop arm 32. Further inductive sensors 54 and 56 or 58 are assigned to the two metallic signal plates 36 and 40 respectively. Connected to the carrier journal 24 is an adjustable butt screw 60 supporting the tension arm 38 which is under the prestress of the tension spring 42.

Figure 2:
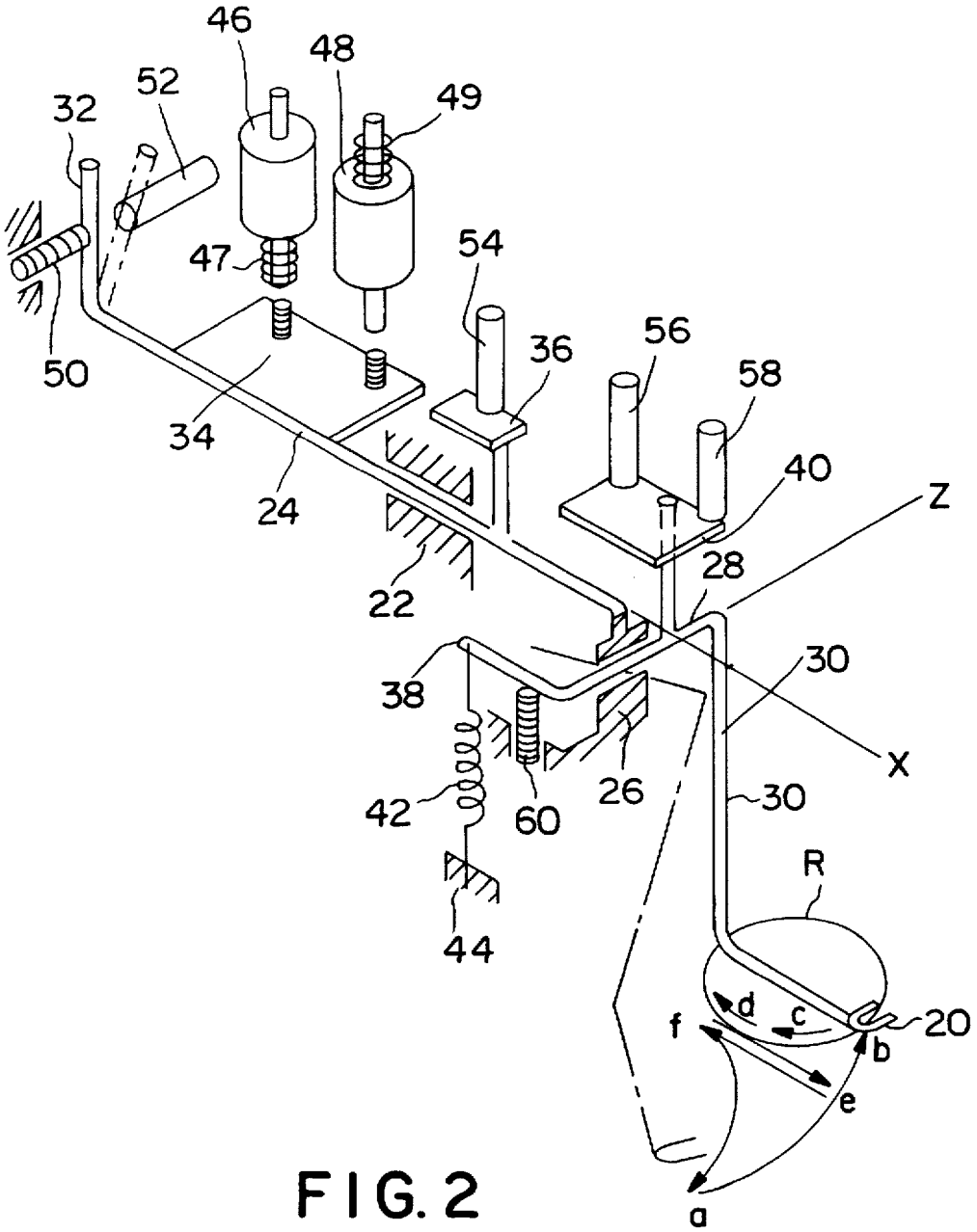
FIG. 2 shows a diagrammatic and perspective representation of the device according to the invention in a first working position.
Figure 3:
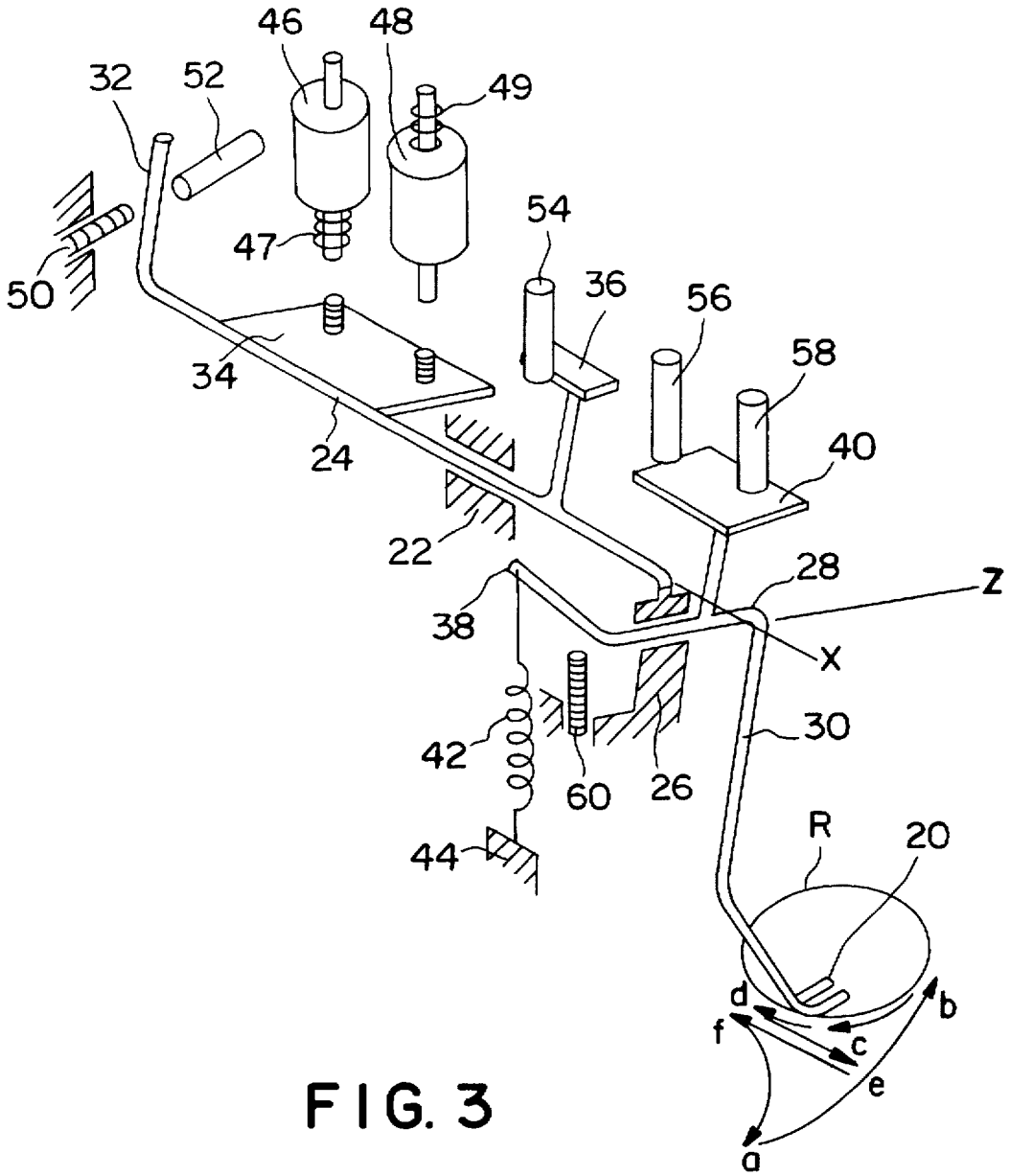
FIG. 3 shows the device in the mode of representation according to FIG. 2, but in another working position.

FIGS. 2 and 3 show the parts of the movement device in physical terms in a first and in a further working position respectively. Moreover, these figures contain diagrammatically the positions, designated by a)–f), and the paths of movement of the thread member which are indicated by single lines. The positions will be discussed in the course of the explanation of the mode of operation of the device in connection with the description of the traveller-changing operation with reference to FIGS. 4 to 9.

It may be mentioned, in the first place, that the actual traveller-changing program is stored in the apparatus 2, preferably by the use of a switching shaft associated with the changing device 4. During rotation, the said switching shaft can actuate switching members via corresponding switching or control cams. Furthermore, such a switching shaft can be qualified to drive implements in order to execute corresponding movements. For example, a switching shaft which is similar to the drive shaft according to the abovementioned EP-A1 can be used. Implements which are moved directly by the switching shaft are preferably the ring-traveller lifting-out implement and the ring-traveller insertion implement. Both implements belong to the changing device 4. For the purposes of the following explanation, it is true to say that, for each change of traveller, the switching shaft executes a predetermined rotational travel, for example one complete revolution, uninterruptedly and preferably at a constant rotational speed.

Figure 4:
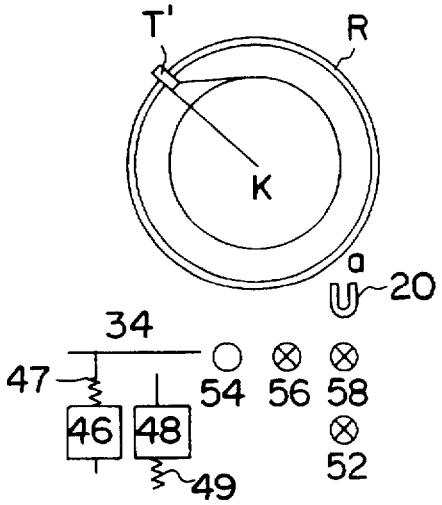
FIGS. 4–9 show the steps of the method according to the invention.

In the initial position of the movement device 10, in which the latter is ready for use at a spinning station for changing the traveller, the spring 47, by acting on the actuating plate 34, holds the carrier journal 24 in a rotary position, in which the thread member 20 is in a position of rest a) (indicated by dot-dashed lines in FIG. 2). In this position of rest, the thread member 20 is held both outside the machine profile and therefore also outside the balloon range of the spinning station. FIG. 4 shows, in horizontal projection, the corresponding position of the thread member 20 relative to the spinning ring R. The stop arm 32 is likewise in the position represented by dot-dashed lines and remote from the stop screw 50. Although the presence of the stop arm 32 in this position is recorded by the sensor 52, this being symbolized by the plus sign in the sensor 52, this nevertheless remains without immediate consequence. The same applies to the signals from the sensors 56 and 58 which both record the presence of the signal plate 40. FIG. 4 also indicates the bearing contact of the electromagnet 46 on the actuating plate 34.

The traveller-changing operation of the apparatus 2, which operation is to be triggered, for example automatically, in the position according to FIG. 1, begins with the switching-on of the drive of the switching shaft. The rotation of the latter brings about the energization of the electromagnet 46 designed as a pulling magnet. This makes it possible, via the actuating plate 34, to rotate the carrier journals 24 about the X-axis. This rotation triggered by the tension spring 42 causes the thread member 20 to be deflected out of the position of rest into a working position b) which is shown in FIG. 2 by unbroken lines and which corresponds to the position in the representation according to FIG. 5. The stop arm 32 runs onto the stop screw 50, with the result that pivoting is limited in a position of the carrier journal 24 determining the working position. The sensor 54 records that this position is reached by means of the signal plate 36 which is moved in accompaniment. The importance of the working position b) of the thread member 20 becomes obvious from the context explained further below.

In any case, the sensor 54 records that the working position of the carrier journal 24 and therefore of the thread member 20 is reached and switches on the drive 6 or its electric motor 12 in the forward direction of rotation. In this direction of rotation, normally, that is to say in the spinning mode, thread Y is wound onto the cop K as a result of the rotation transmitted to the latter, in the present case in the clockwise direction (FIG. 5). As is known, the rotation of the cop results in a rotational movement of the traveller T' in the same direction on the ring R. In this case, the traveller is taken up by drag by the thread Y. In the working position b), the thread member 20 is located above and directly over the spinning ring R in the path of rotation of the thread Y extending between the balloon limiter and traveller T'. Furthermore, the thread member 20 is open approximately in the anti-clockwise direction. As a result, the rotation in the clockwise direction produced by the rotation of the cop K now causes the thread to run automatically into the thread member 20. The thread Y is intercepted on the latter and, by virtue of the suspension of said thread, a tensile force takes effect on the thread member 20. This leads to the deflection of the thread member 20, and indeed, as a result of the direction of the tensile force, to a composite movement, according to the degrees of freedom provided. On the one hand, the carrier journal 24 is pivoted about the axis X. On the other hand, a deflection of the lever 30 takes place about the axis Z pivoted in accompaniment. The two movements act on the tension arm 38 and on the tension spring 42. The tension spring 42 is tensioned further, in that it stores tensile force transmitted by the thread. By virtue of the composite movement, the thread member 20 can follow approximately the path of the traveller T' on the ring R, this being indicated by the position represented in FIG. 6. The movements involved are evident particularly from the position of the stop arm 32 relative to the stop screw 50, of the signal plate 36 relative to the sensor 54 and of that of the tension arm 38 relative to the butt screw 60 in FIG. 3.

Figure 6:
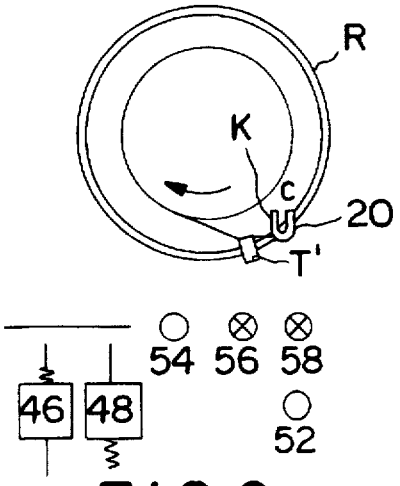

The sensor 54 records the pivoting of the signal plate 40 and consequently supplies a signal which means that a predetermined position c) of the thread member 20 has been reached. The position c) is approximately that according to FIG. 6, and the signal shuts down the drive 6. FIG. 6 also represents the position of the traveller T' during this shut-down.

If no signal from the sensor 54 occurs within a predetermined period of time from the switching-on of the spindle drive to the beginning of the changing operation, this means, for example, that there is no thread at the spinning station, because a thread break has already taken place previously. In the exemplary embodiment explained, the traveller-changing operation is discontinued. The drive 6 is stopped by the apparatus control and the control shaft is rotated back into the initial position. The apparatus 2 thereupon becomes free for changing the traveller at an adjacent spinning station. Whether a change of traveller, basically possible even in the absence of a thread, is carried out is obviously of no significance in the present connection.

Under normal conditions at the spinning station, the switching shaft has in the meantime actuated the traveller lifting-out implement and placed the lifting-out hook 18 of the latter (see FIG. 10) onto the ring R. Immediately thereafter, the drive is switched on a second time in the forward direction of rotation, that is to say in the clockwise direction of the cop K, but this time by means of the switching shaft. Consequently, the traveller T', which has continued to be dragged along during the deflection of the thread member 20, is drawn onto the lifting-out hook 18 and into the effective range of the detent wheel 16 assigned to the latter. During the rotation of the cop K in the clockwise direction, this detent wheel 16 itself executes a rotation in the clockwise direction and, as a result of frictional take-up, moves the traveller T' into a position blocked on the lifting-out hook 18. This also blocks the detent wheel 16 itself, with the result that the electric motor and the friction wheel 15 are blocked, that is to say stopped suddenly. This prevents the tensile force on the thread Y from increasing. The thread member 20 consequently comes to a standstill in a position of equilibrium d) which, although being located near the blocked traveller T', is nevertheless at all events at a distance from this. The corresponding positions of the traveller T' and of the thread member 20 emerge from FIG. 7.

After a time interval of suitable duration, the switching shaft has brought about the reversal of the electric motor 10 and the cop K is then rotated in the anti-clockwise direction. Correspondingly, thread Y is unwound from this and, at the same time, reduces the thread tension taking effect on the thread member 20. The energy stored as additional spring tension therefore tends to move the thread member 20 with the effect of reducing this energy. However, during the reversal of the drive 6 triggered by the switching shaft, the electromagnet 48 has also been energized. This magnet, via the actuating plate 34, prevents the carrier journal 24 from being pivoted out of the position according to FIG. 3. A movement of the thread member 20 about the X-axis thus becomes impossible. The relaxation of the tension spring 42 must consequently be caused by a pivoting of the thread member 20 solely about the Z-axis. The path of this thread member, on which unwound thread Y is taken up, therefore runs in an imaginary, approximately vertical plane intersecting the ring R. As a consequence of the above-described spatial orientation of the axes X and Z, this plane is oriented transversely to the direction of movement of the traveller insertion mechanism. The thread Y is then stretched in this plane until the sensor 58 responds. FIG. 8 represents the corresponding end position e) of the thread member 20 and also illustrates the thread Y which is stretched between the thread member and traveller T' and which forms a threading-in zone Y1. As seen in elevation, and starting from the traveller T', the threading-in zone Y1 formed by a straight line runs at a slight upward inclination, but directly above the surface of the ring R.

The unwinding of thread Y from the cop K, triggered by the switching shaft, has been terminated by the signal from the sensor 58 as a result of the pivoting of the signal plate 40 together with the thread member 20. It should be added that the reverse rotation of the electric motor 10 does not result in any unblocking of the detent wheel 16 or any release of the blocked traveller T'. The corresponding reverse rotation is absorbed by the lost-motion coupling 13.

By the agency of the switching shaft, the traveller insertion implement is then actuated and, at the same time, by means of an insertion hook 19 of the latter, a new traveller T" is brought up in an orientation open towards the ring R. The path of movement of the hook or of the traveller T", the said path of movement being directed towards the ring R, crosses the threading-in zone Y1 approximately at right angles or directly intersects the latter. The new traveller T" consequently grasps the thread Y positively, specifically even before the insertion hook 19 has attached this onto the ring R. When the traveller T" is then located on the ring R, the thread Y is contained in or guided through the latter. This situation is utilized later, being discussed further below.

After reaching the attachment position, the insertion hook 19 is drawn back into the initial position by means of the switching shaft. Now, since the thread is grasped in the new traveller T", the old traveller T' can be removed from the ring R. This takes place by means of the retracting movement of the lifting-out hook 18 brought about by the switching shaft. When the old traveller T' has released the ring, the thread Y slides out of the former. The drive 6 is then switched on in the forward direction of rotation by the switching shaft. At the same time, the cop K rotating in the winding direction pulls on the thread Y once again, this likewise having an effect on the traveller T" and on the thread member 20 still containing the thread Y. With the electromagnet 48 still energized, this leads to a reverse pivoting of the lever 30 about the axis Z counter to the force of the tension spring 42. The thread member 20 is pivoted into the position f). The sensor 58 records the movement of the signal plate 38 corresponding to the lever pivoting over a predetermined travel.

The response of the sensor 58 immediately brings about the shutdown of the drive 6 and causes the magnets 46 and 48 to drop. Under the effect of the magnet spring 47 which overcomes the force of the tension spring 42, the carrier journal 24 is pivoted about the axis X. This leads first to a retraction of the thread member 20 approximately in the radial direction. At the same time, the thread Y leading to the new traveller T" is released. The tension spring 42 can relax and pivots the thread member 20 about the axis Z into the initial position a).

The response of the sensor 56, taking place in a predetermined time interval, for example since the switching-on of the spindle drive or of the rotation of the cop, is interpreted by the control device as a report that the traveller-changing operation has been successfully concluded. This report, which obviously differs in quality from that by which the conclusion of the rotational movement of the switching shaft can be detected and which is linked to a signal from the sensor 52, releases the traveller-changing apparatus for movement to the next adjacent spinning station. Alternatively, the control device can trigger this movement.

It goes without saying that the spring characteristic and the prestress of the tension spring 42 are coordinated with the prevailing circumstances and particularly with tear resistance values of the thread.

The cardanically mounted thread member and the parts movable together with this are designed with low mass. Correspondingly, the forces resulting on the thread or the tensile stresses occurring are at all times of a magnitude limited ultimately by the spring. Since the further pulling of thread takes place by means of the spring acting as a force accumulator and, at most, may generate tensile stresses in the thread which this thread had transmitted itself during the storage of force, thread breaks caused by excessive tensile stresses consequently should not occur. In the case of proper thread material, no thread break can occur even during the attachment of the new traveller or during the removal of the old traveller.

If no signal indicating the successful change of traveller comes from the sensor 56 after a predetermined time interval, the changing operation is discontinued. What may be considered as a cause of the fault is, for example, the absence of new travellers in the changing device 4. The control device can be designed to record the unsuccessful change of traveller, in order, after a predeterminable number of failed operations, to provide an operator with an acoustic and/or optical signal or to shut down the traveller-changing apparatus 2. Normally, the apparatus 2 is allowed to locate an adjacent spinning station, even after a traveller-changing operation which has not been successfully concluded.

It goes without saying that the energy accumulator can also have other forms, for example in that it stores position energy. Instead of a single energy accumulator which can absorb or emit energy as a result of movements about the two axes, that is to say the pivoting of the carrier 24 and the pivoting of the axle journal, each axis can be assigned its own energy accumulator with fundamentally the same result.

It can be seen from the foregoing explanations that the movement device as a whole can have small dimensions. This makes it possible to encase the bearings, etc. of the latter against dust, even though little room is available. The movement device also has the advantage, by virtue of assigning the sensors to the carrier and to the axle journal, of making it possible to monitor the traveller-changing operation from a distance, that is to say from outside the range of the ring.

I claim:

1. A thread moving device adapted for mounting on a traveller-changing assembly for a ring spinning machine, the ring spinning machine including a ring and a rotatably mounted cop for carrying thread, said device comprising:

first and second articulated pivot members connected to the traveller-changing assembly and defining a cardan joint for movement of the members about first and second intersecting cardanic axes;

a thread-receiving member formed at a working end of said second pivot member for being positioned adjacent the ring of the ring spinning machine for receiving a portion of thread;

energy storage biasing means engaging a connecting end of the second pivot member and cooperating with guide means for moving the thread-receiving member about the cardanic axes between a plurality of positions relative to the ring;

said guide means including a detent arranged for blocking movement of the first pivot member about the first cardanic axis beyond a predetermined point, such that when movement of the first pivot member is blocked, said biasing means effects movement of the second pivot member and the thread-receiving member about the second cardanic axis.

2. A device according to claim 1, wherein the energy storage biasing means comprises a tension spring.

3. A device according to claim 1, wherein the detent comprises an electromagnet.

* * * * *